US005318230A

United States Patent [19]

Ferguson et al.

[11] Patent Number: 5,318,230

[45] Date of Patent: Jun. 7, 1994

[54] GARBAGE DISPOSAL ASSEMBLY WITH DECORATIVE SINK FLANGE MASK

[75] Inventors: Lloyd G. Ferguson, Marietta, Ga.; Peter J. Taylor, Bishops Wood, United Kingdom

[73] Assignee: Delta Engineering Holding Limited, London, United Kingdom

[21] Appl. No.: 817,779

[22] Filed: Jan. 8, 1992

[51] Int. Cl.[5] ..... B02C 18/42

[52] U.S. Cl. ..... 241/46.013; 241/46.015

[58] Field of Search ..... 241/46.015, 46.016, 241/46.013

[56] References Cited

U.S. PATENT DOCUMENTS

| | | | |
|---|---|---|---|
| 3,880,363 | 4/1975 | Guth et al. | 241/100.5 |
| 3,982,703 | 9/1976 | Meyers | 241/100.5 |
| 4,310,933 | 1/1982 | Stratman | 4/286 |
| 4,752,035 | 6/1988 | Felder | 241/46.016 |

OTHER PUBLICATIONS

In-Sink-Erator Marketing Information for a Disposal Assembly, 1989.

*Primary Examiner*—Timothy V. Eley
*Assistant Examiner*—John M. Husar
*Attorney, Agent, or Firm*—Louis T. Isaf

[57] ABSTRACT

An improved garbage disposal assembly with an apparatus and related method for selectively varying the sink-side appearance of the garbage disposal assembly. In its preferred embodiment, the apparatus of the present invention includes a decorative flange mask for covering a sink flange of a garbage disposal. A sink flange includes an open cylindrical body portion for insertion through a drainage hole of a sink bottom and an annular lip portion extending radially outward from one end of the cylindrical body portion for location above the sink bottom. The decorative flange mask, in accordance with the preferred embodiment of the present invention, includes an open cylindrical mask body for insertion into the cylindrical body portion of the sink flange and an annular mask lip connected to and extending radially outward from one end of the cylindrical mask body for covering the annular lip portion of the sink flange.

12 Claims, 3 Drawing Sheets

GARBAGE DISPOSAL ASSEMBLY WITH DECORATIVE SINK FLANGE MASK

BACKGROUND OF THE INVENTION

The present invention relates generally to the field of garbage disposals, and, in its most preferred embodiments, to the field of garbage disposal sink attachments.

Ordinary stainless steel sinks have existed for many years. More recently, sinks have become available in a variety of colors to match various kitchen interior designs. While colored sinks often enhance the appearance of a kitchen, an ordinary stainless steel sink flange of a garbage disposal frequently sticks out like a sore thumb when installed in a colored sink. The typical garbage disposal is supplied with an ordinary stainless steel sink flange. When installed, the ordinary stainless steel sink flange does not match the colored sink and, therefore, detracts from the overall appearance of the sink.

One method of achieving continuity in color between the sink and the disposal sink flange is to replace the ordinary stainless steel disposal sink flange with an appropriately colored replacement sink flange. There are, however, many problems related to this course of action. Many garbage disposal assemblies are relatively difficult to disassemble and reassemble with new sink flanges. Furthermore, many consumers are unable, or unwilling, to engage in a task which is usually quite unpleasant and requires an extensive amount of time. Therefore, the various problems relating to disassembling and reassembling garbage disposals render this option impractical for many people in many environments.

There is, therefore, a need in the industry for an apparatus which solves these and other related, an unrelated, problems.

SUMMARY OF THE INVENTION

Briefly described, the present invention comprises a garbage disposal assembly with an apparatus and related method for selectively varying the sink-side appearance of the garbage disposal assembly. In its preferred embodiment, the apparatus of the present invention includes a decorative flange mask for covering a sink flange of a garbage disposal. A sink flange includes an open cylindrical body portion for insertion through a drainage hole of a sink bottom and an annular lip portion extending radially outward from one end of the cylindrical body portion for location above the sink bottom.

The decorative flange mask, in accordance with the preferred embodiment of the present invention, includes an open cylindrical mask body for insertion into the cylindrical body portion of the sink flange and an annular mask lip connected to and extending radially outward from one end of the cylindrical mask body for covering the annular lip portion of the sink flange.

Rather than requiring any disassembly of a previously installed garbage disposal, the installation of the preferred embodiment of the present invention involves the quick and easy steps of applying a sealant around the flange mask and pushing the flange mask straight down into the open cylindrical body portion of the sink flange of the garbage disposal. After these convenient steps, the ordinary stainless steel sink flange of the garbage disposal is, for the most part, hidden from view.

It is therefore an object of the present invention to provide a decorative flange mask for covering a sink flange of a garbage disposal.

Another object of the present invention is to provide a decorative flange mask whose installation is easy and convenient.

Another object of the present invention is to provide a decorative flange mask which is easily removed and exchanged.

Yet another object of the present invention is to provide a decorative flange mask which includes an open cylindrical mask body and an annular mask lip connected to and extending radially outward from one end of the cylindrical mask body.

Still another object of the present invention is to provide a decorative flange mask which includes an open cylindrical mask body with an outer annular groove for receiving an inner annular ridge of an open cylindrical body portion of a disposer sink flange upon insertion of the open cylindrical mask body into the open cylindrical body portion.

Still another object of the present invention is to provide an improved garbage disposal assembly which includes a garbage disposal body unit, a sink flange, a mounting assembly for securing the garbage disposal body unit and the sink flange to the sink, and a flange mask for covering the sink flange.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
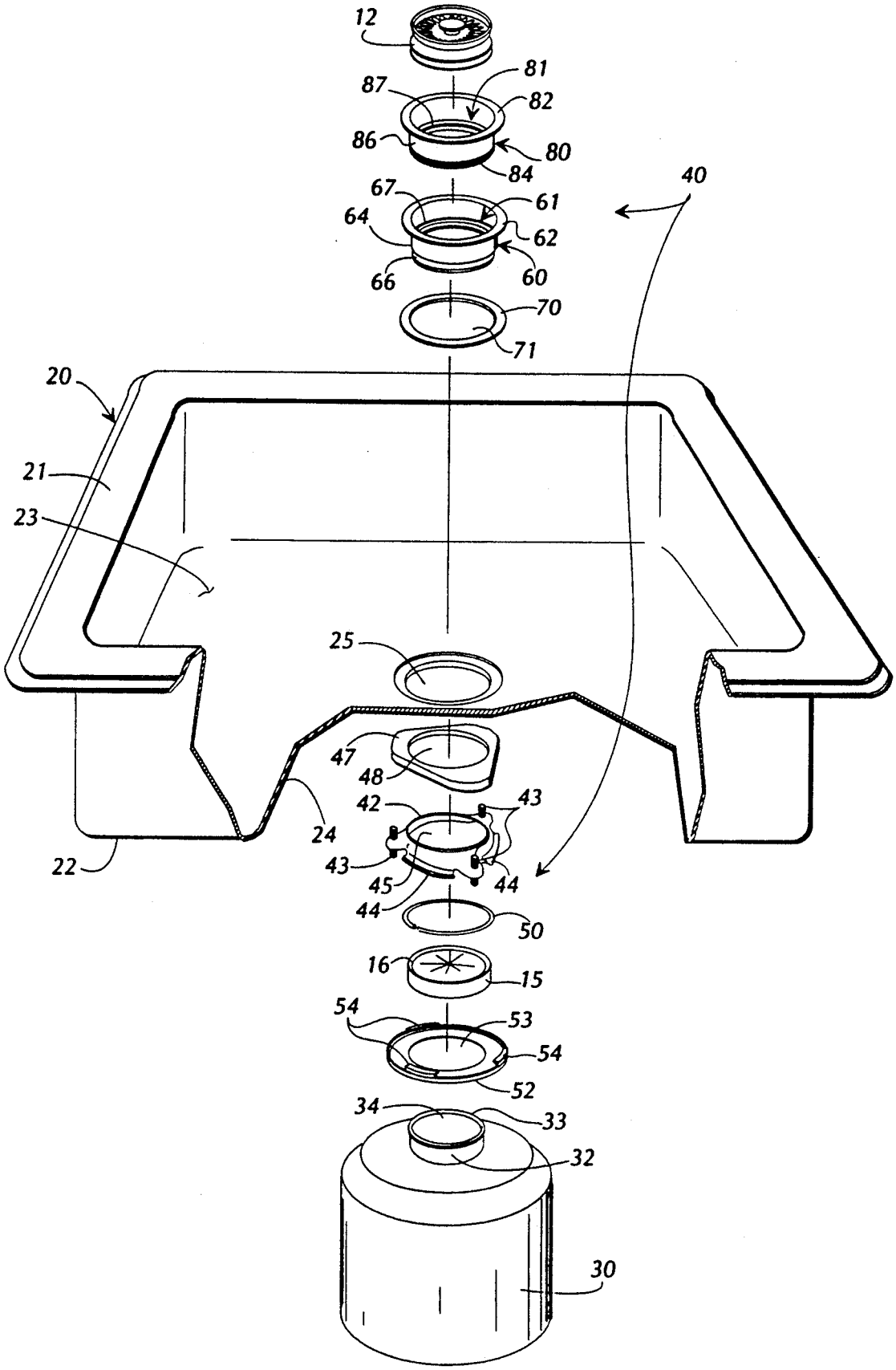
FIG. 1 is an exploded perspective view of a Garbage Disposal Assembly With a Decorative Sink Flange Mask in accordance with the preferred embodiment of the present invention shown with a cut-away view of a sink.

Referring now in greater detail to the drawings, in which like numerals represent like components throughout the several views, the preferred embodiment of a garbage disposal assembly 10, improved in accordance with the present invention, is shown in an exploded perspective view in FIG. 1 with a cut-away view of a sink 20. The sink 20 includes a sink top 21 and a sink bottom 22. The sink bottom 22 includes a sink bottom upper surface 23 and a sink bottom lower surface 24. Located at the center of the sink bottom 22 is a sink drain 25 which is defined by a cylindrical passageway. One example of an acceptable sink 20 is the well-known enamel-coated, stainless steel sink which is commonly available in a variety of colors. References to "sink-side" appearances of the garbage disposal assembly 10 refer to top views showing the sink bottom upper surface 23.

The garbage disposal assembly 10 consists of a disposal body unit 30, an attachment assembly 40, a flange mask 80, and a strainer-stopper 12. It should first be understood that examples of an acceptable disposal body unit 30 and attachment assembly 40 of the preferred embodiment of the present invention are available from In-Sink-Erator®, a division of Emerson Electric Co., of Racine, Wis. Accordingly, the operation and interrelationship of the elements of the disposal body unit 30 and attachment assembly 40 are considered well-known and understood by those reasonably skilled in the art.

The disposal body unit 30 includes a body collar 32 which defines a collar passage 34 through which garbage passes into the disposal body unit 30. A collar lip 33 encircles the distal end of the body collar 32. The attachment assembly 40 connects the disposal body unit 30 to the sink bottom 22. Included in the attachment assembly 40 is a body ring 52, a baffle cap 15, a snap ring 50, a mounting ring 42, a back-up ring 47, a flange gasket 70, and a sink flange 60.

The body ring 52 is seen having three body ring hooks 54 and defining a body ring passage 53 which is sized to pass around the collar lip 33 and down the body collar 32. A rubber baffle cap 15 with a baffle inset 16 is designed to snap onto the body collar 32 to secure the body ring 52 against the disposal body unit 30. The remaining elements of the attachment assembly 40, along with the flange mask 80, are seen assembled in the sink bottom 22 in the cross-sectional view of FIG. 2, which should also be referred to during the following description.

The sink flange 60 is seen defining a flange passage 61 and including a flange lip 62 and a flange body 64. Defined around the outer surface of the flange body 64 is an annular ring groove 66. A corresponding annular ring ridge 67 is seen on the inside of the flange body 64. The flange gasket 70 is seen defining a gasket passage 71 and being sized to pass around the flange body 64 of the sink flange 60. The back-up ring 47 and mounting ring 42 are seen defining a back-up ring passage 48 and a mounting ring passage 45, respectively, which are also sized to pass around the flange body 64 of the sink flange 60. The mounting ring 42 also includes three mounting screws 43 and three mounting ledges 44.

Figure 2:
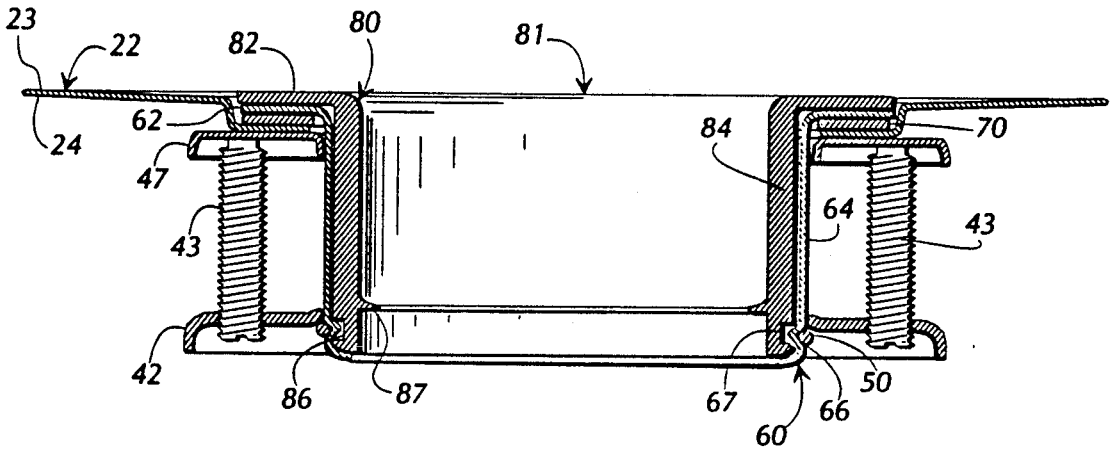
FIG. 2 is a cross-sectional view of portions of the garbage disposal assembly of FIG. 1 shown installed in a sink.
Figure 3:
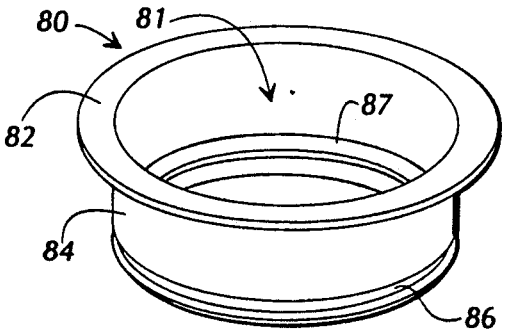
FIG. 3 is a perspective view of the flange mask of FIG. 1.
Figure 4:
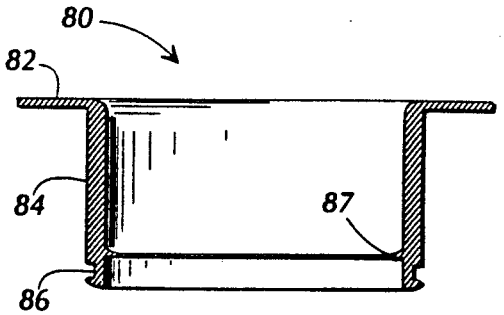
FIG. 4 is a cross-sectional view of the flange mask of FIG. 1.
Figure 5:
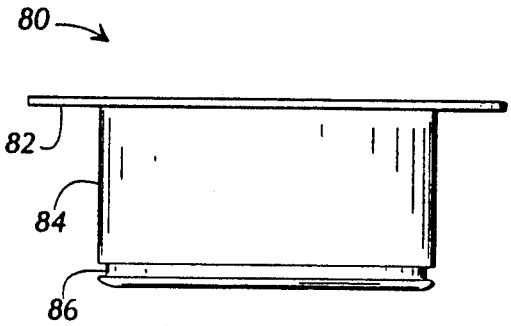
FIG. 5 is a front elevational view of the flange mask of FIG. 1.
Figure 6:
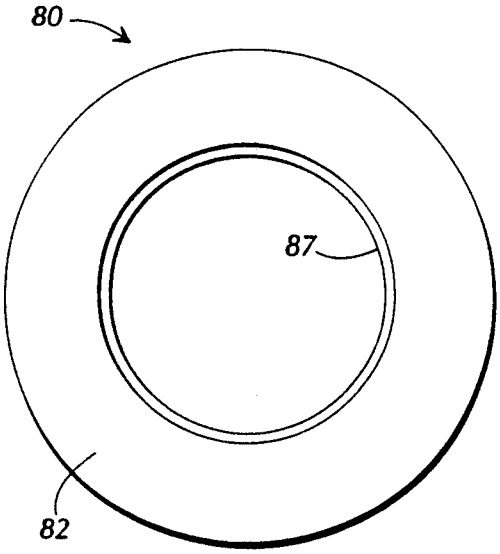
FIG. 6 is a top view of the flange mask of FIG. 1.
Figure 7:
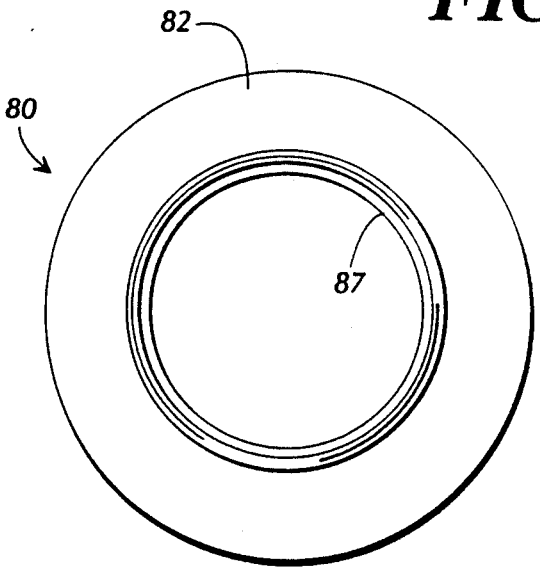
FIG. 7 is a bottom view of the flange mask of FIG. 1.

During assembly, the flange body 64 is inserted through the gasket passageway 71 of the flange gasket 70 and then inserted through the sink drain 25. At this point, the flange lip 62 rests on the flange gasket 70 which abuts the sink bottom upper surface 23. The back-up ring 47 is then passed around the flange body 64 to abut against the sink bottom lower surface 24. The mounting ring 42 is then passed around the flange body 64 until the mounting screws 42, loosened for assembly, contact the back-up ring 47. The snap ring 50 is then attached around the ring groove 66 to prevent the mounting ring 42 from slipping off of the flange body 64. The mounting screws 43 are then tightened to secure the assembly to the sink 20, as is shown in FIG. 2. Referring to FIG. 1, the disposal body unit 30, along with the baffle cap 15 and body ring 52, are then attached by rotating the body ring hooks 54 over the mounting ledges 44 so that the bottom of the flange body 64 is seated into the baffle inset 16.

The flange mask 80, which is also seen in several views in FIGS. 3–7, defines a mask passage 81 and includes a mask lip 82 and a mask body 84. An annular mask groove 86 is defined around the outside of the mask body 84, and an annular stopper ridge 87 is defined around the inside of the mask body 84. In the preferred embodiment, the flange mask 80 is constructed of colored plastic to match the color of the sink 20. During assembly, after a common sealant is applied to the underside of the mask lip 82, the mask body 84 is inserted downward into the flange passage 61. Insertion ceases when the mask lip 82 seals against flange lip 62 and the mask groove 86 engages the ring ridge 67 to lock the flange mask 80 into place. The strainer-stopper 12 is sized to fit into mask passage 81 and rest on the stopper ridge 87. In the preferred embodiment, the strainer-stopper 12 is of a common construction which enables a user to selectively stop the flow of water through the mask passage 81.

It should be understood that in alternate embodiments of the present invention, the mask groove 86 is alternately shaped to correspond to alternately shaped flange bodies 64 and/or alternately shaped annular ring ridges 67 of the sink flange 60. Furthermore, alternate attachment assemblies 40, including, without limitation, flange bodies with threaded outer surfaces, (some of which are already known in the art) are also contemplated within the scope of the present invention.

Also, other qualities of appearance of the sink flange 60, such as texture, are varied through the use of other flange masks 80 in accordance with other alternate embodiments. Furthermore, various draining properties of the sink 20 are selectively altered with other flange masks 80 in accordance with other alternate embodiments.

While the embodiments of the present invention which have been disclosed herein are the preferred forms, other embodiments of the apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that any relative dimensions and relationships shown on the drawings are given as the preferred relative dimensions and relationships, but the scope of the invention is not to be limited thereby.

I claim:

1. A garbage disposal apparatus for use in a sink having a sink bottom with a sink drainage hole defined therein, said garbage disposal apparatus comprising:

a disposal body unit;

a sink flange including, at least, an open cylindrical body portion for insertion into a sink drainage hole, and an annular lip portion connected to and extending radially outward from one end of said cylindrical body portion for being located above said sink bottom;

a mounting means for securing said sink flange to said sink bottom and for supporting said disposal body unit from said sink flange; and a flange mask including, at least, an open cylindrical mask body for insertion into said cylindrical body portion of said sink flange, an annular mask lip connected to and extending radially outward from one end of said open cylindrical mask body for being located above said annular lip portion of said sink flange, and an engagement means associated with said open cylindrical mask body for securing said flange mask to said sink flange.

2. Apparatus of claim 1, wherein said cylindrical body portion of said sink flange includes an inner annular ridge, and wherein said engagement means is defined by said open cylindrical mask body of said flange mask as an outer annular groove for receipt of said inner annular ridge of said cylindrical body portion of said sink flange.

3. Apparatus of claim 1, wherein said flange mask is composed of selectively colored plastic.

4. Apparatus of claim 1, wherein said flange mask is designed to be mounted into said sink flange through one downward push of said flange mask into said sink flange.

5. Apparatus of claim 1, further comprising seal means for providing a seal between said annular lip portion of said sink flange and said annular mask lip of said flange mask.

6. Apparatus of claim 1, wherein said mounting means includes, at least, a back-up ring mounted around said cylindrical body portion of said sink flange and located adjacent said sink bottom, a mounting ring mounted around said cylindrical body portion of said sink flange below said back-up ring for supporting said disposal body unit.

7. Apparatus of claim 6, wherein said cylindrical body portion of said sink flange defines an outer annular groove, wherein said mounting means further includes, at least, a support ring located, at least partially, within said outer annular groove of said cylindrical portion of said sink flange, and wherein said mounting ring is mounted above said support ring to receive support from said support ring which receives support from said outer annular groove.

8. Apparatus of claim 7, wherein said support ring defines a spring snap ring, and wherein said mounting means further includes, at least, mounting screw means attached to said mounting ring for adjustably biasing said back-up ring toward said sink bottom.

9. Apparatus of claim 7, wherein said support ring defines a rubber ring, and wherein said back-up ring is threadably connected to said cylindrical body portion of said sink flange.

10. A garbage disposal apparatus for use in a sink having a sink bottom with a sink drainage hole defined therein, said garbage disposal apparatus comprising:

a disposal body unit;

a sink flange including, at least, an open cylindrical body portion for insertion into a sink drainage hole and including, at least, an inner annular ridge, and defining an outer annular groove, and an annular lip portion connected to and extending radially outward from one end of said cylindrical body portion for being located above said sink bottom;

a mounting means for securing said sink flange to said sink bottom and for supporting said disposal body unit from said sink flange, said mounting means including, at least, a back-up ring mounted around said cylindrical body portion of said sink flange and located adjacent said sink bottom, a support ring located, at least partially, within said outer annular groove of said cylindrical body portion of said sink flange a mounting ring mounted around said cylindrical body portion of said sink flange below said back-up ring and above said support ring for receiving support from said support ring to support said disposal body unit;

a flange mask composed of selectively colored plastic and designed to be mounted into said sink flange through one downward push of said flange mask into said sink flange, said flange mask including, at least, an open cylindrical mask body for insertion into said cylindrical body portion of said sink flange and defining, at least, an outer annular groove for receipt of said inner annular ridge of said cylindrical body portion of said sink flange, wherein said outer annular groove is located below the sink bottom adjacent a bottom end of said open cylindrical mask body, an inner support means for supporting a stopper within said open cylindrical mask body, wherein said inner support means includes an inwardly extending annular ridge, and an annular mask lip connected to and extending radially outward from one end of said open cylindrical mask body for being located above said annular lip portion of said sink flange;

seal means for providing a seal between said annular lip portion of said sink flange and said annular mask lip of said flange mask; and a stopper means supported by said inner support means of said flange mask for impeding water flow through said open cylindrical mask body.

11. Apparatus of claim 10, wherein said support ring defines a spring snap ring, and wherein said mounting means further includes, at least, mounting screw means attached to said mounting ring for adjustably biasing said back-up ring toward said sink bottom.

12. Apparatus of claim 10, wherein said support ring defines a rubber ring, and wherein said back-up ring is threadably connected to said cylindrical body portion of said sink flange.

* * * * *